US006775957B2

(12) United States Patent
Chen et al.

(10) Patent No.: US 6,775,957 B2
(45) Date of Patent: Aug. 17, 2004

(54) PHARMACEUTICAL PRODUCT PROTECTION METHOD AND APPARATUS

(75) Inventors: Grant Chen, Cary, NC (US); Saingeun Houatchanthara, Raleigh, NC (US)

(73) Assignee: Axon Corporation, Raleigh, NC (US)

( * ) Notice: Subject to any disclaimer, the term of this patent is extended or adjusted under 35 U.S.C. 154(b) by 0 days.

(21) Appl. No.: 10/114,654

(22) Filed: Apr. 2, 2002

(65) Prior Publication Data

US 2003/0182902 A1 Oct. 2, 2003

(51) Int. Cl.[7] ..... B65B 63/02; B65B 55/20
(52) U.S. Cl. ..... 53/438; 53/115; 53/474
(58) Field of Search ..... 53/115, 474, 438, 53/529

(56) References Cited

U.S. PATENT DOCUMENTS

| | | | | | |
|---|---|---|---|---|---|
| 2,171,572 | A | * | 9/1939 | Kelly | 53/115 |
| 2,412,089 | A | * | 12/1946 | Kelly | 53/435 |
| 2,691,473 | A | * | 10/1954 | Gantzer | 53/115 |
| 2,810,245 | A | * | 10/1957 | Dimond | 53/115 |
| 2,817,934 | A | * | 12/1957 | Dimond | 53/115 |
| 2,860,464 | A | * | 11/1958 | Barthelemy | 53/115 |
| 2,895,269 | A | * | 7/1959 | Lasko et al. | 53/429 |
| 2,895,273 | A | * | 7/1959 | Lasko | 53/438 |
| 3,030,748 | A | * | 4/1962 | Moses | 53/115 |
| 3,066,460 | A | | 12/1962 | Lakso | |
| 3,137,979 | A | * | 6/1964 | Lasko | 53/115 |
| 3,224,157 | A | * | 12/1965 | Lasko | 53/473 |
| 3,280,533 | A | | 10/1966 | Hall | |
| 3,537,228 | A | * | 11/1970 | Cremieux | 53/506 |
| 3,810,343 | A | * | 5/1974 | Palomo | 53/423 |
| 3,863,795 | A | | 2/1975 | Mills | |
| 4,279,351 | A | | 7/1981 | Vertes | |
| 4,460,090 | A | | 7/1984 | Paoletti | |
| 4,805,789 | A | | 2/1989 | Lancesseur et al. | |
| 4,890,753 | A | | 1/1990 | Duryee et al. | |
| 5,096,078 | A | | 3/1992 | McQueeny | |
| 5,411,156 | A | | 5/1995 | Reckamp | |
| 5,709,066 | A | * | 1/1998 | Prochaska et al. | 53/429 |
| 5,738,234 | A | | 4/1998 | Harrold | |
| 6,389,783 | B1 | * | 5/2002 | Segal | 53/527 |
| 6,505,457 | B2 | * | 1/2003 | Grass et al. | 53/435 |

FOREIGN PATENT DOCUMENTS

| | | | | |
|---|---|---|---|---|
| AU | 265419 | * | 2/1966 | |
| GB | 736979 | * | 9/1955 | 94/1 |
| GB | 832752 | * | 4/1960 | 94/1 |
| SU | 0628029 | * | 10/1978 | B65B/5/00 |
| SU | 0763197 | * | 9/1980 | B65B/61/22 |

* cited by examiner

*Primary Examiner*—Scott A. Smith
*Assistant Examiner*—Paul Durand
(74) *Attorney, Agent, or Firm*—Michael R. Philips

(57) ABSTRACT

A hydrophobic, compressible, resilient filler for keeping pills from movement in a container during handling is provided in the form of a tube that is cut to a desired length and axially compressed in horizontal orientation. The tube is compressed and inserted through the neck portion of the container and allowed to expand to become entrapped within the container so as to apply pressure to keep the pills from movement or damage. An apparatus and method is disclosed for extending a desired length of filler in flattened tubular form from a large supply, to cut the length of tube from the supply, to reconfigure the cross-sectional shape of the filler tube, to axially compress the rounded tube, and to insert the axially compressed filler into a container that is aligned with the insertion ram.

8 Claims, 8 Drawing Sheets

PHARMACEUTICAL PRODUCT PROTECTION METHOD AND APPARATUS

FIELD OF THE INVENTION

The present invention relates to the field of pharmaceutical packaging, and more particularly to inserting a resilient material into a container after a plurality of pills have been packaged therein.

BACKGROUND OF THE INVENTION

Medications or vitamins are often conveniently provided in the form of pills, i.e., tablets or capsules packaged in a container, typically a bottle. Pills provide uniform dose size in a convenient form for administration. Pills may, however, be damaged due to rough handling of the bottle in transit. A solution to the handling problem has been practiced for many years by inserting a ball of cotton into the headspace of the bottle above the pills so that the pills are held under gentle pressure to prevent movement. While overcoming the potential damage problem, cotton has a drawback of being hydrophilic, thus tending to absorb moisture. If the cotton filler absorbs moisture from the pills, the pills could change chemically with a reduction from the intended amount of moisture and could be more easily, or spontaneously, cracked. Alternatively, if cotton already having a high moisture content is placed in a pill bottle, adverse effects of excess moisture in the pills could result. Cotton also has the drawback of being accidentally torn during the removal process. While it has been recognized that replacing cotton with a plastic material could overcome the problems indicated above, no commercially practical solution has been developed to date.

SUMMARY OF THE INVENTION

A hydrophobic, compressible, resilient, tube is advanced in flattened form from a roll supply to a cutter to be cut into desired lengths. Each cut length of flat tube is converted to a round cross sectional shape, inserted horizontally into a compressing cavity and axially compressed to compact its length. The compressed tube is inserted with its axis oriented horizontally into the headspace above a quantity of pills and below the neck of a container and allowed to expand. The expanded tube occupies the headspace and keeps the pills from movement when the container is handled.

BRIEF DESCRIPTION OF THE DRAWINGS

FIGS. 1–4 illustrate the sequence of compressing and inserting the filler into the container.

FIG. 2 is the pill container and filler of FIG. 1 wherein the length of the filler is axially compressed.

FIG. 3 is the pill container and filler of FIG. 2 wherein the compressed length of filler is inserted into the container.

FIG. 4 is the pill container and filler of FIG. 3 wherein the compressed filler has expanded within the container.

DETAILED DESCRIPTION OF THE INVENTION

Figure 1:
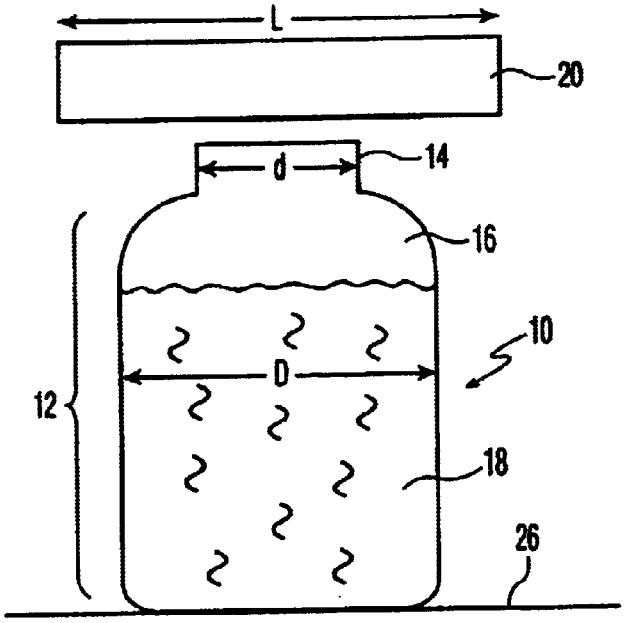
FIG. 1 is a front elevation view of a pill container having a quantity of pills therewithin and an uncompressed filler positioned thereabove.

A typical container, or bottle, 10, intended for packaging of pharmaceutical or nutritional products, is illustrated in FIG. 1 as being supported on conveyor 26. The body portion 12 of container 10 is designated as having a diameter D, and the neck 14 has a diameter d, body diameter D being normally greater than neck diameter d. If body diameter D is equal to neck diameter d, container 10 is termed a vial. Container 10 holds a quantity of products, being in the form of tablets or capsules, known collectively as pills 18. Typically, a headspace 16 is left empty in container 10 above pills 18. It is considered standard practice to fill container 10 with pills 18 to approximately 80% of the capacity of container 10.

A length L of a filler 20 is shown positioned above the neck 14 of container 10. Length L is greater than body diameter D of container 10. Filler 20 is preferably formed of a hydrophobic, compressible, and resilient material. It is also desired that filler 20 should be fairly pliant so that it will conform to the contour of the pills in container 10. Filler 20 may be, for example, formed of polyvinylchloride (PVC) or is preferably formed of polyethylene (P/E) resin. According to the present invention, filler 20 is preferably formed as a continuous length tube and is supplied in a roll form; thus the tube is initially substantially flat, as will be described more fully below.

Figure 2:
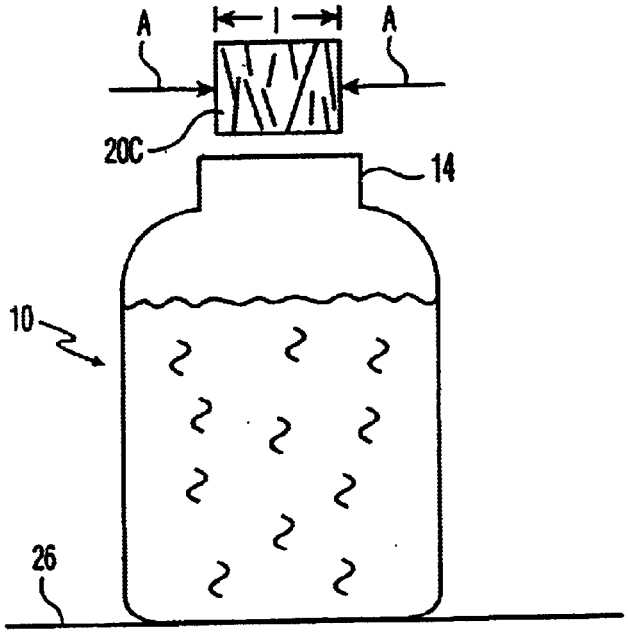

Referring now to FIG. 2, container 10 and its contents are identical to that described in relation to FIG. 1. Upon the application of a force, represented as arrows A—A, filler 20 (FIG. 1) is axially compressed to become compressed filler 20*c*, having a length l. Compressed length l is less than diameter d of neck 14.

Figure 3:
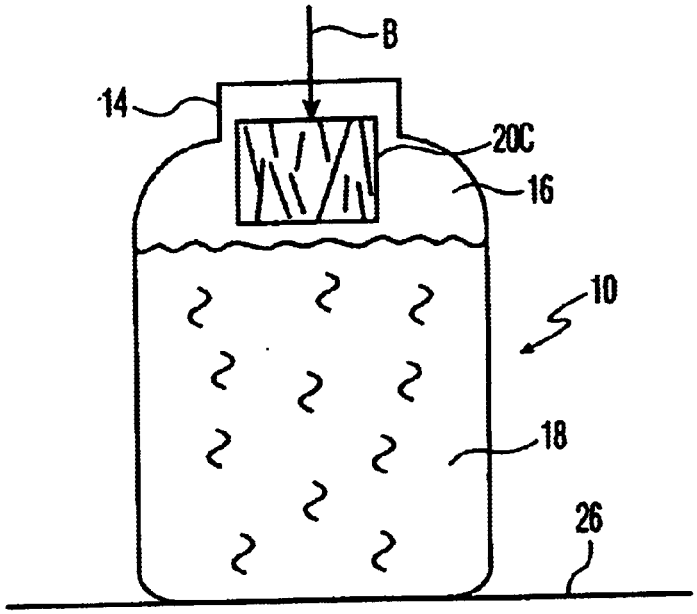

Referring now to FIG. 3, by application of a downward force, represented as arrow B, compressed filler 20*c* is inserted into container 10 through neck 14 and positioned in contact with the upper surface of pills 18 in headspace 16.

Figure 4:
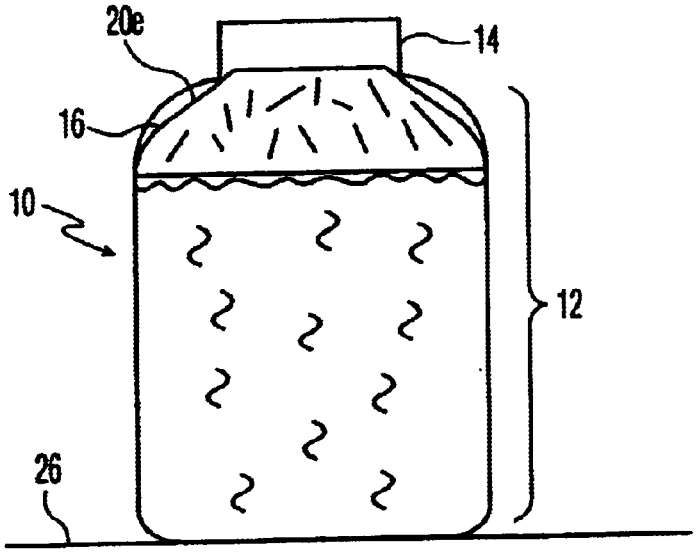

Whereas filler 20*c* is formed of a resilient material, filler 20*c* rapidly expands to become expanded filler 20*e* and assert firm contact with the inner surface of container 10, as shown in FIG. 4. The lower portion of released filler 20*e* has expanded to contact the inner wall of container 10 body portion 12 and the upper portion has been confined by the inner diameter d of neck 14. In this configuration, filler 20*e* is restrained from escaping through neck 14 due to its resiliency pressing outwardly against the inner wall of container 10. In another embodiment, released filler 20*e* may reside fully below neck 14 and within body portion 12 of container 10. In still another embodiment of the invention, container 10 may be in the form of a vial, that is a container having a top opening as large as its body diameter, and with no neck constriction to restrain the upward movement of filler 20*e*. In all cases, the degree of resiliency of filler 20*e* will affect the retention of filler 20*e* within container 10. As will be understood by those skilled in the art, the degree of resiliency of filler 20 will depend upon several factors, including the type of plastic resin used, whether the resin is of high or low density, the thickness of the tube wall, the diameter of the tube formed, and the tube length. By way of example, for insertion into a container having a neck diameter of 27 mm, a tube formed of extruded low density polyethelyne with a 50 $\mu$m (0.002 inch) wall thickness and an outer diameter of 32 mm is used. The cut length of filler 20 is established in relation to body diameter D of the particular container 10 that is used. According to various characteristics of filler 20, ambient temperature, and the machine components which filler 20 contacts, filler 20 may assume a round or a flat cross section during the mechanical insertion process.

Figure 5:
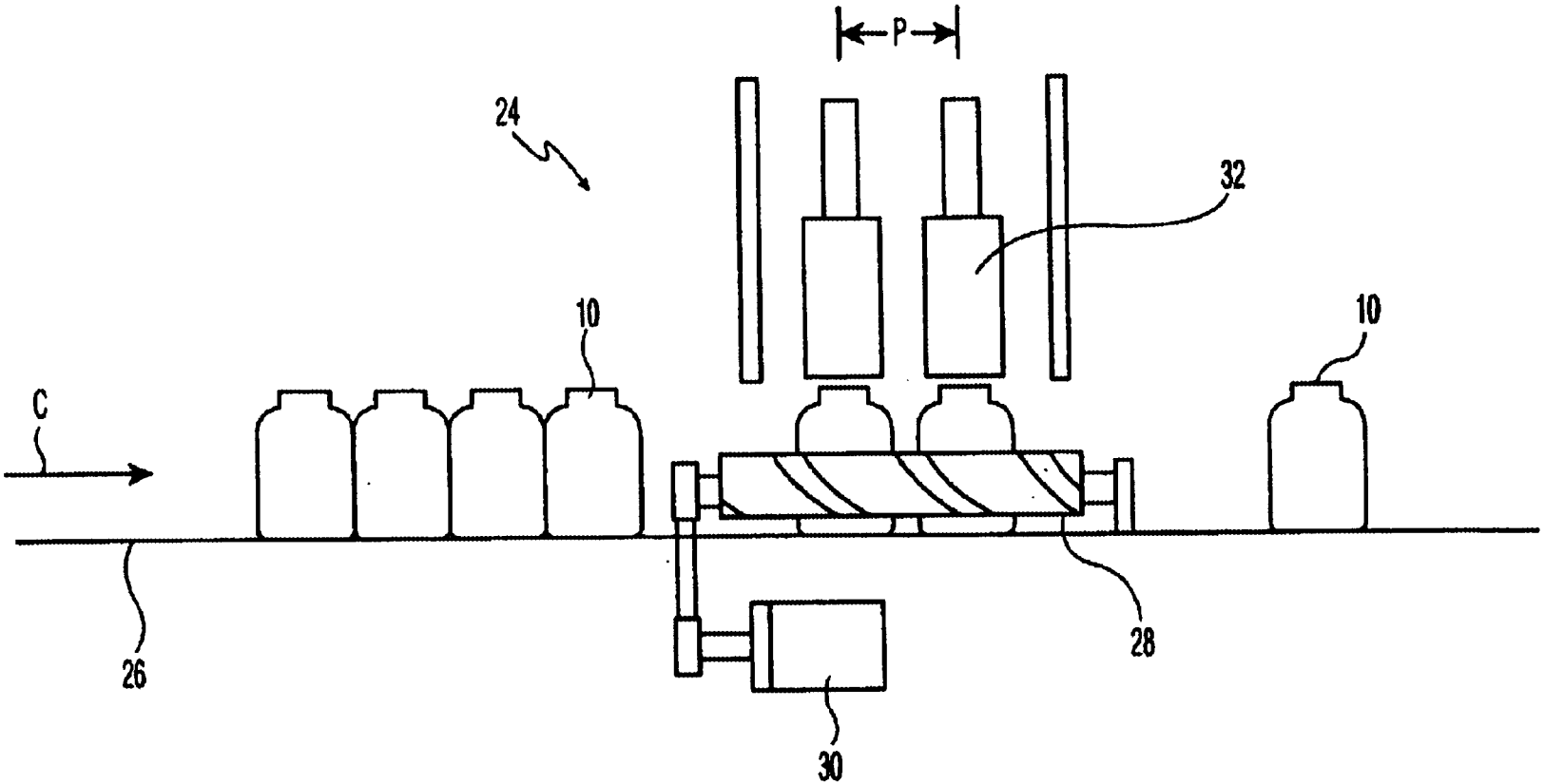
FIG. 5 is a front elevation schematic view of the filler insertion apparatus of the invention.

Referring now to FIG. 5, the filler compression and insertion apparatus of the present invention is illustrated in front elevation view as a two-head machine. It is understood that the principles of the invention disclosed are not restricted by the number of heads comprising the apparatus. A conveyor 26 moves a series of containers 10 in the direction indicated by arrow C to be engaged by lead screw 28. Lead screw 28 moves sequential containers 10 so as to follow one another by a pitch distance P as containers 10 travel below a pair of filler insertion stations 32. Filler insertion stations 32 are also separated by pitch distance P to fill two containers 10 simultaneously. A rail or wall (not shown) is provided adjacent the opposite side of containers 10 to ensure that lead screw 28 firmly engages and controls the movement of each container 10. Lead screw 28 is driven intermittently by drive motor 30 or other suitable means to intermittently move sequential pairs of containers 10 beneath insertion stations 32 and stop their travel while insertion stations 32 operate to insert a filler in each container 10 as will be described in detail below. When a filler has been inserted into each container 10, containers 10 are carried by conveyor 26 to a sequential operation, for example affixing a "tamper-evident" top seal.

Figure 6:
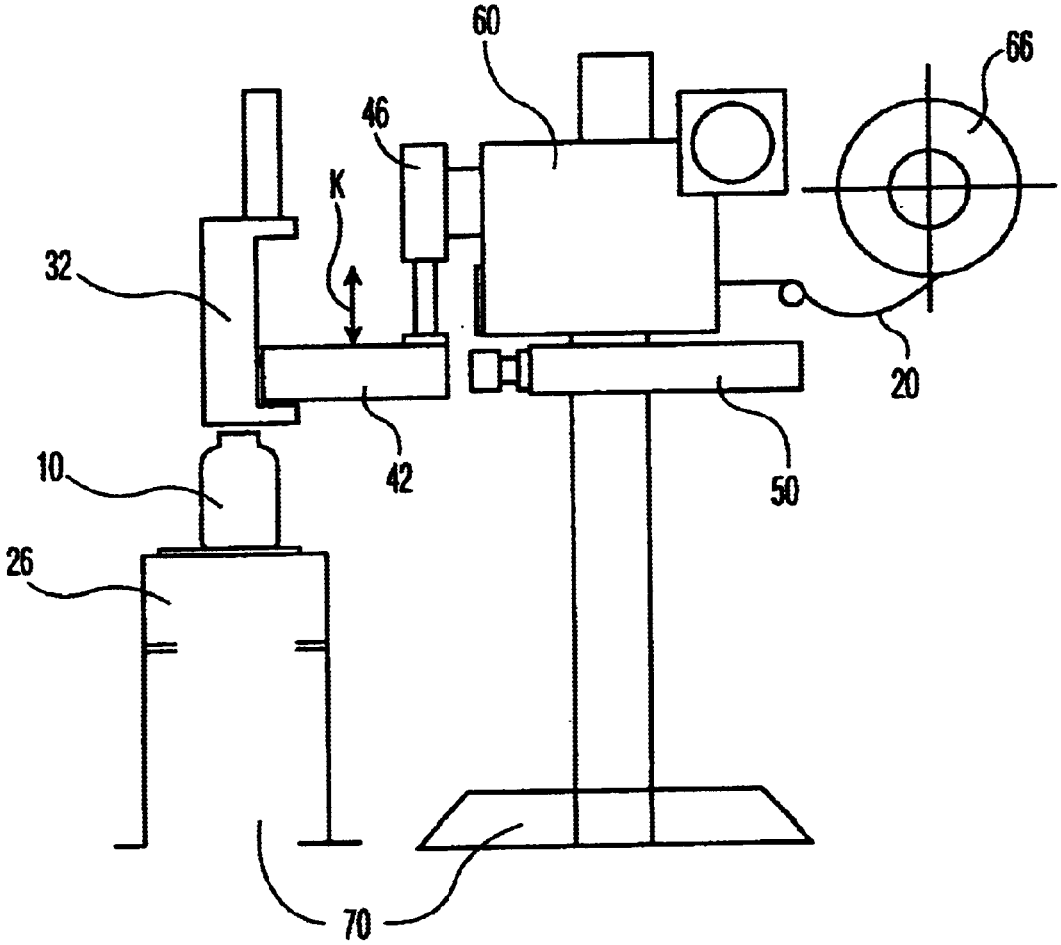
FIG. 6 is a side elevation schematic view of the filler insertion apparatus of the invention.

FIG. 6 provides a side elevation view of the filler insertion apparatus of FIG. 5. The filler 20 described above is provided in flattened tube form from filler supply reel 66 and drawn into filler advancement station 60. While filler 20 is a continuous supply of flattened tube according to the preferred embodiment of the invention, it is understood that other forms of hydrophobic filler could be employed without departing from the scope of the invention, for example a round tube, a flat, non-tubular film and pre-cut lengths of material. The filler insertion apparatus of the invention is supported on bases 70. Insertion station 32 includes compression cavity 42 that is moved vertically as shown by arrow K between a level adjacent the point where filler 20 emerges from filler advance station 60 to a level adjacent a compression ram 50. Compression tube 42 is moved between levels by elevator drive 46, of any known type, e.g. a pneumatic cylinder.

Figure 7:
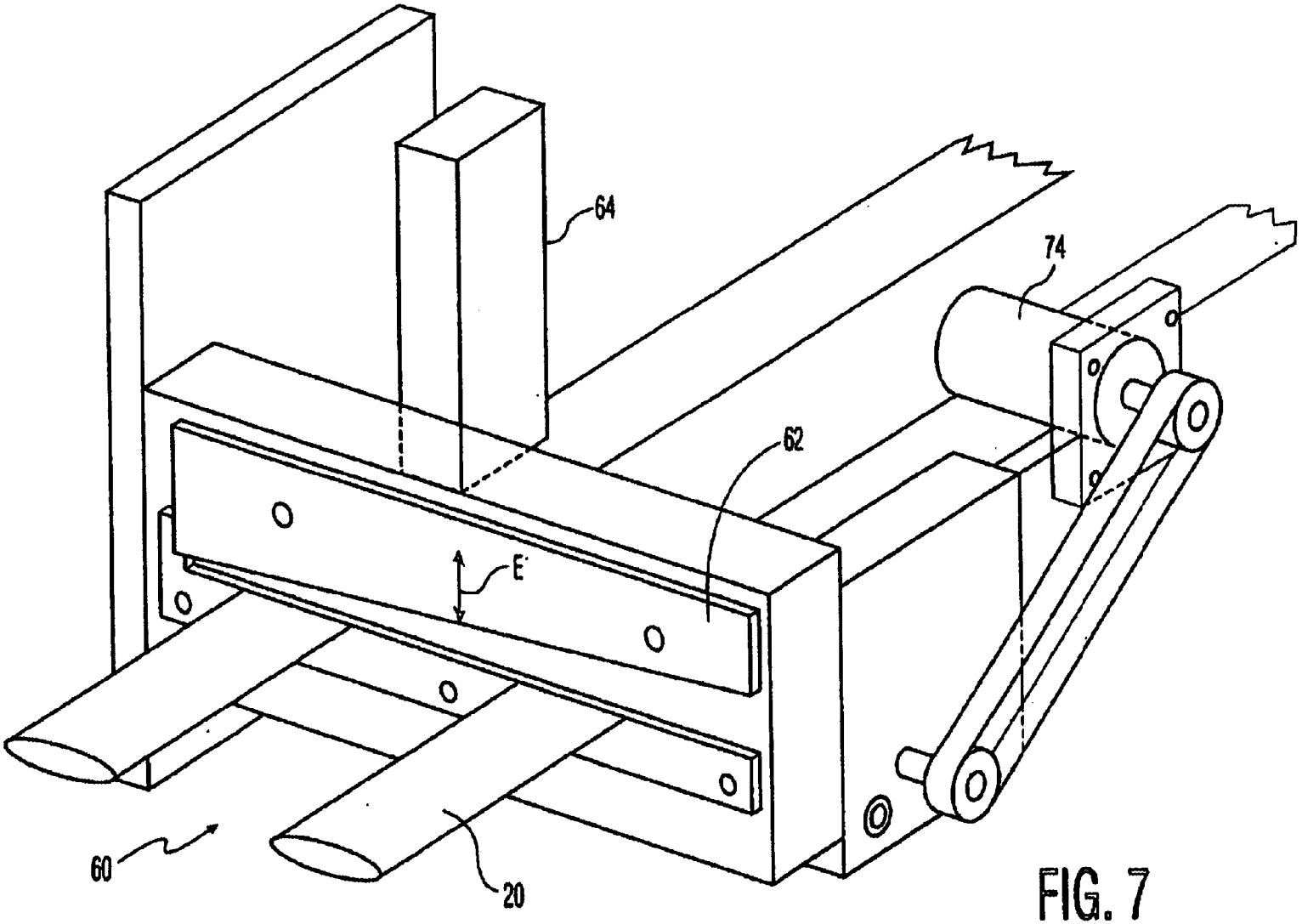
FIG. 7 is a perspective schematic view of a filler handling and cutting mechanism as seen from the filler exit end.

FIG. 7 illustrates details of filler advancement station 60 in perspective view. A set of drive rollers (not shown) are intermittently rotated by drive motor 74, or other appropriate drive means, so as to advance a selected length each of two of filler tubes 20 through cutter 62. When the selected length of filler 20 extends beyond cutter 62, cutter 62 is activated in the direction shown by arrow E by, for example, cylinder 64 to cut a length of filler 20 for subsequent insertion into container 10. It is understood that the length of filler 20 beyond cutter 62 is supported in compression cavity 42 (FIG. 6) so as not to fall when cut. Drive motor 74 awaits an instruction to indicate that a further advancement of filler 20 is needed before operating again.

Figure 8A:
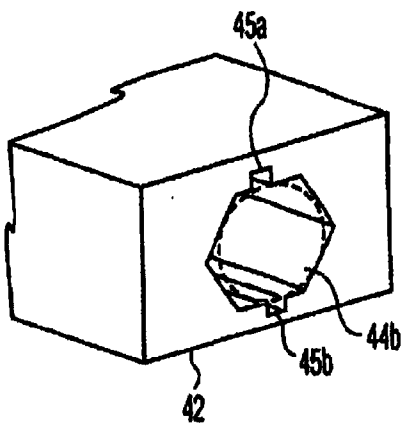
FIG. 8A is a perspective schematic view of an exit end of the filler compression cavity of FIG. 8.
Figure 8:
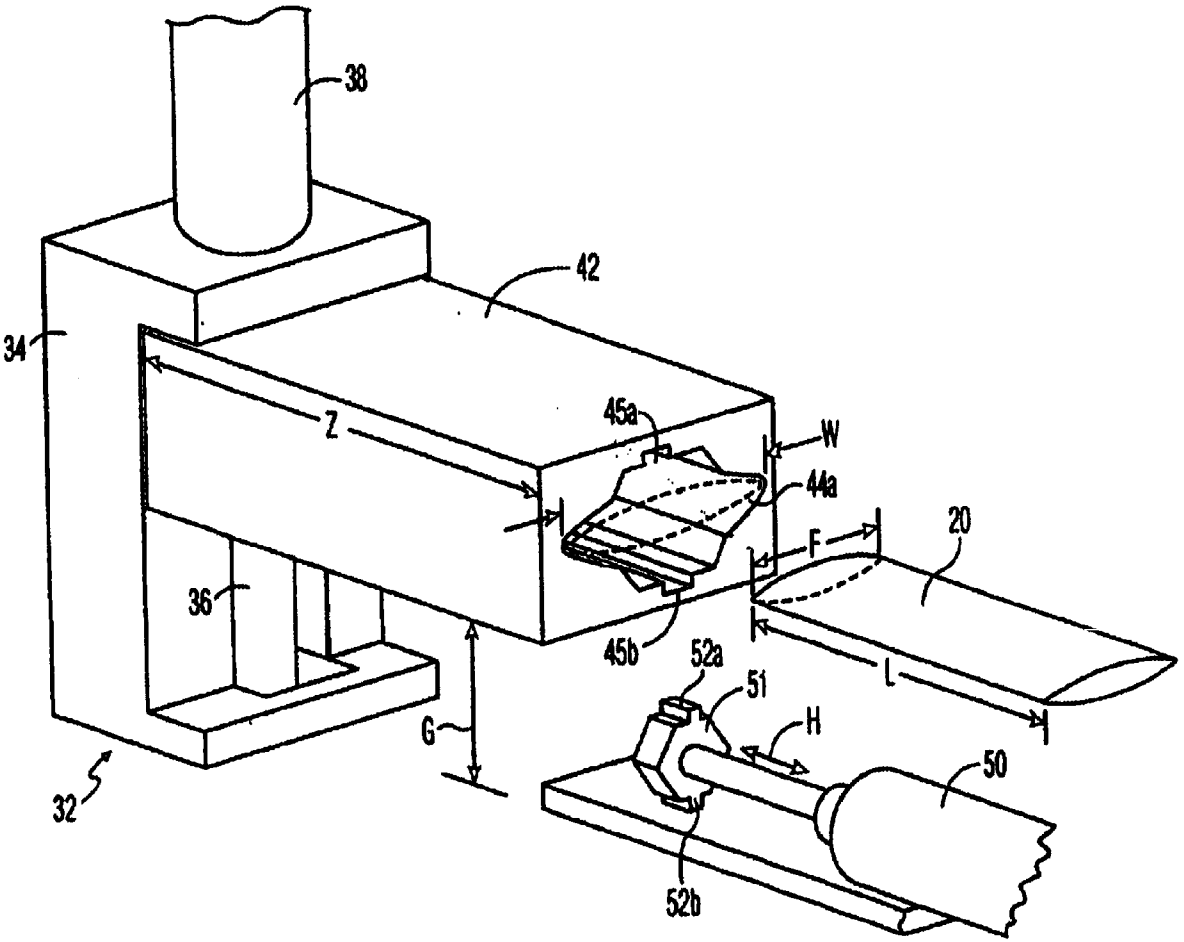
FIG. 8 is a perspective schematic view of a filler compression and transfer station as seen from the filler insertion end of a compression cavity.

A single length of filler 20 is shown in FIG. 8 as exiting from cutter 62 (FIG. 7) and about to enter compression cavity 42 in its upper position, with filler 20 positioned in axial alignment therewith. The length L of filler 20 cut by cutter 62 (FIG. 7) is equal to or less than the length Z of compression cavity 42. Once a cut length of filler 20 is inserted in compression cavity 42, compression cavity 42 is lowered according to arrow G by elevator drive 46 (FIG. 6) of any functional type to a position axially aligned with ram 51. As noted above, filler 20 is in the form of a substantially flattened tube and has a flattened width F. Compression cavity 42 is formed with an entry 44*a* having a substantially decahedral shape, derived from laterally expanding a hexagon. Entry 44*a* is formed with a horizontal maximum width W that is sufficient to receive width F of flattened filler 20 therewithin. The contour of flattened filler 20 is illustrated within entry 44*a* in dashed lines. The exit end of compression cavity 42 is shown in FIG. 8A to depict exit 44*b* as hexagonal. Exit 44*b* is substantially the same size and shape as the hexagonal portion of entry 44*a* without the expanded triangular side portions. Thus, the internal configuration of compression cavity 42 gradually transitions from a decahedron to a hexagon, allowing filler 20 to radially expand in shape from flat to substantially round in passage therethrough. The contour of rounded filler 20 is shown in dashed lines in tangential contact with the planar surfaces of hexagonal exit 44*b*. It will be understood by those skilled in the art that with ram 51 configured as a hexagon and sized to fit slidingly within exit 44*b*, that when tubular material 20 is radially expanded to tangentially contact the planar surfaces of exit 44*b*, ram 51 effectively pushes against the portions of tubular filler material 20 between tangential contact points to avoid pinching of filler 20.

However, as noted above, the tendency of filler 20 to assume a round cross-sectional shape is dependent on numerous factors, and filler 20 will also typically assume a draped, non-circular cross-section in many instances. An upper slot 45*a* and a lower slot 44*b* are formed respectively along the upper and lower inner surfaces of the hexagonal portion of compression cavity 42. A pair of tabs 52*a* and 52*b* are formed on upper and lower horizontal surfaces of ram 51 in an orientation to slidingly engage slots 45*a* and 45*b* in compression cavity 42. The addition of tabs 52*a* and 52*b* improves the reliability of ram 51 to compress filler 20 without pinching the walls thereof.

Figure 9:
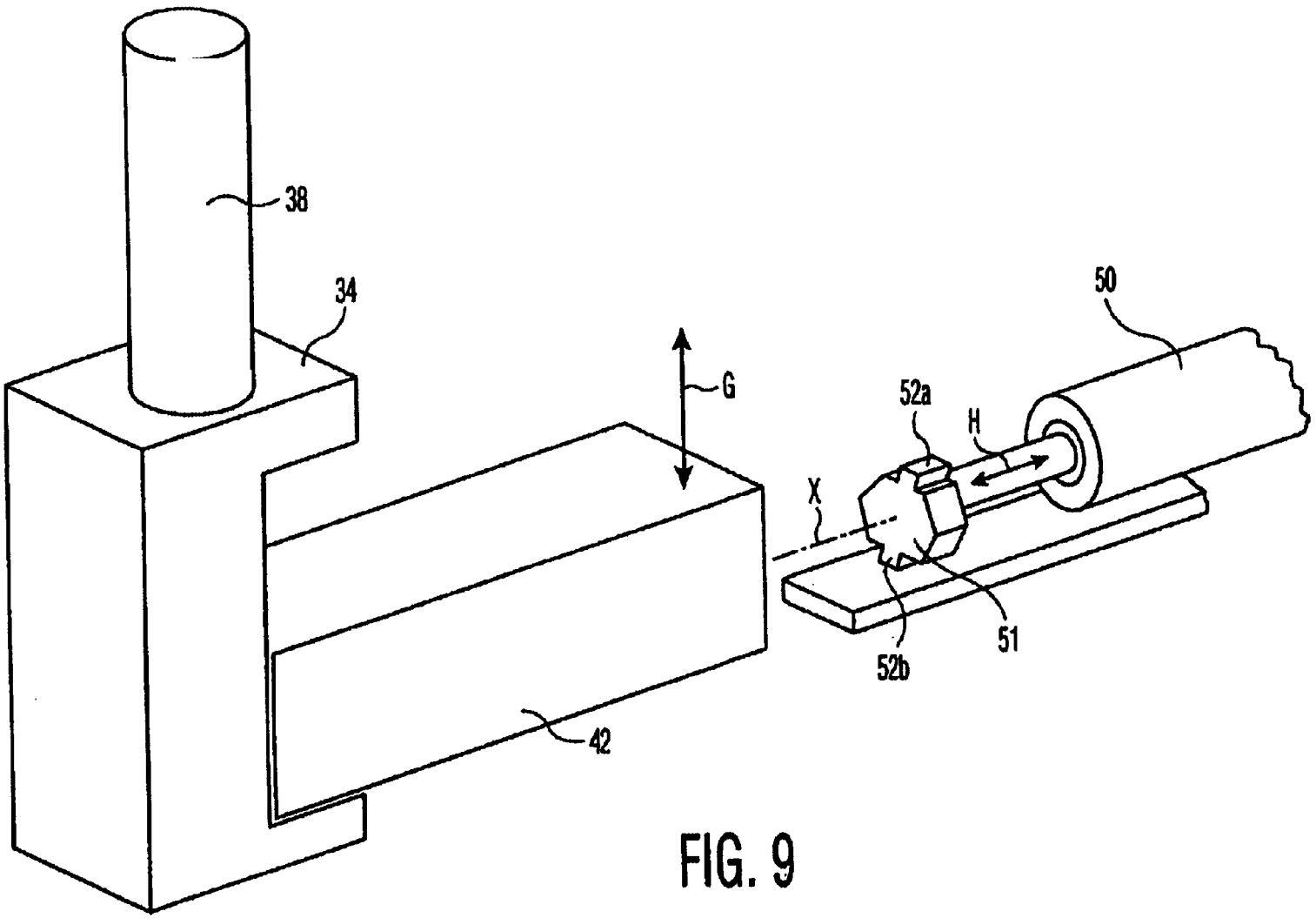
FIG. 9 is a perspective schematic view of the filler compression and transfer station as seen from the transfer end.

Compression cavity 42 is shown in its bottom position in FIG. 9 with a central axis X thereof extending from the center of entry 44*a* to the center of exit 44*b* (FIGS. 8, 8A). Axis X is substantially aligned with compression ram 51 of compression drive 50. Compression ram 51 is caused to extend and retract in the direction indicated by arrow H by compression drive 50, for example a pneumatic cylinder, so as to axially compress filler 20 within compression cavity 42 and drive compressed filler 20 through compression cavity 42 into an insertion chute.

Figure 10:
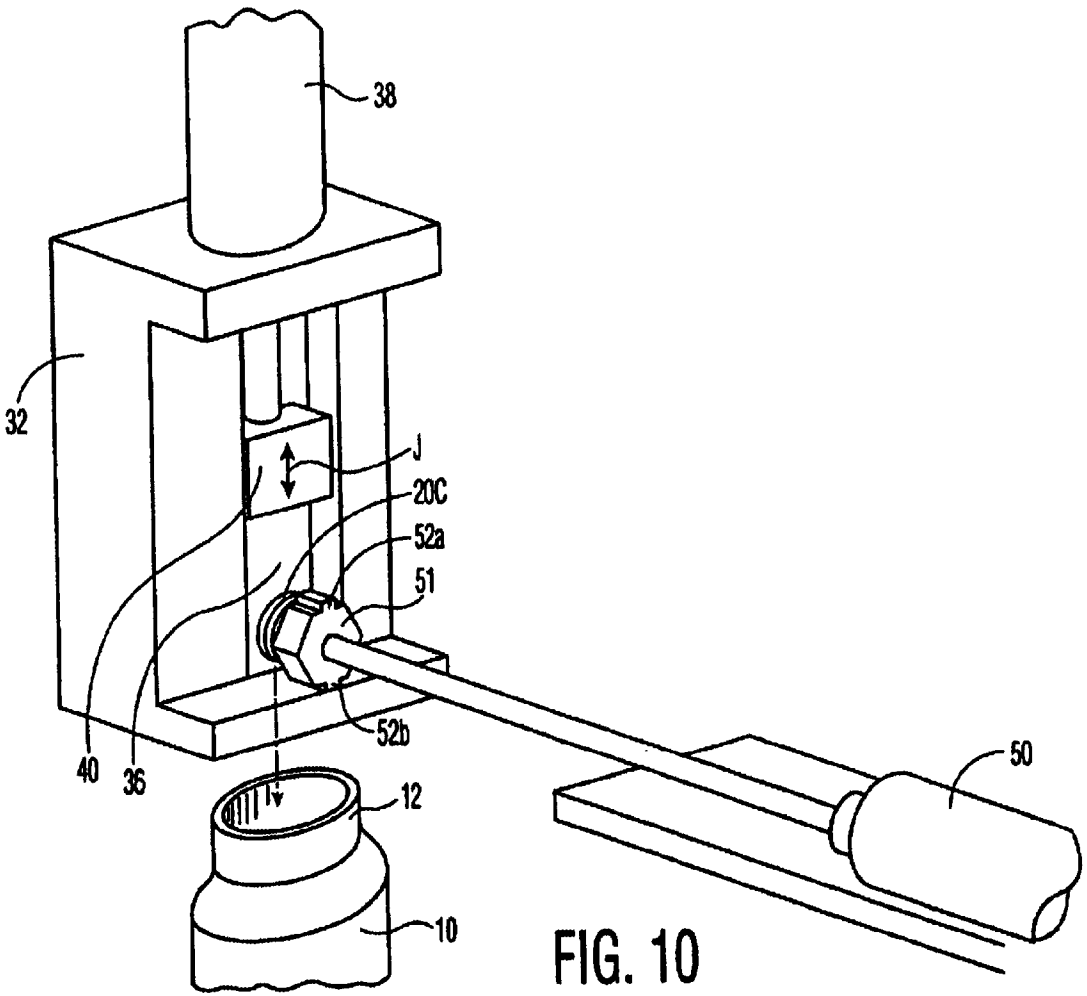
FIG. 10 is a perspective schematic view of the filler compression and transfer station with the filler compression cavity removed for clarity and the filler fully compressed for insertion into a container.

FIG. 10 illustrates compression ram 51 in its fully extended condition, but with compression cavity 42 (FIG. 9) removed for clarity. Insertion chute 36 is formed vertically in insertion station 32, to be oriented perpendicular to the travel of compression ram 51, and axially aligned above a container 10 as described above in relation to FIG. 5. An insertion ram 40 is connected to an insertion driver 38 so as to be driven along insertion chute 36 in the direction indicated by arrow J when compressed filler 20*c* is in position therebelow. Insertion driver 38, a pneumatic cylinder or other appropriate mechanism, drives compressed filler 20*c* from between compression ram 51 and insertion chute 36 through neck 12 and into container 10, where compressed filler 20*c* expands axially to be trapped therewithin, as shown in FIG. 4.

Thus, the preferred embodiment of the invention provides: a supply of compressible, resilient material in communication with means for introducing the material to a compressor for compressing the material and mounted to a frame adjacent the means for introducing the material to the compressor; an inserter is mounted in a location to receive a compressed length of material from the compressor; means mounted and adapted for positioning sequential containers so that a top opening of a container is vertically axially oriented with the inserter; means to activate the inserter so as to insert a compressed length of material into the selected container, which compressed length is subsequently allowed to expand horizontally.

As described above, the invention provides a method for supplying a length of flattened, resilient, compressible, hydrophobic tubular material cut from a roll to a desired length, forming the flattened tube to become radially compacted, compressing the tube axially and inserting the axially compressed tube into the neck of a bottle containing pills so as to substantially occupy the headspace above the pills.

While the present invention is described with respect to specific embodiments thereof, it is recognized that various modifications and variations may be made without departing from the scope and spirit of the invention, which is more clearly and precisely defined by reference to the claims appended hereto.

What is claimed is:

1. A method for protecting a plurality of pharmaceutical products formed as pills and packaged in a container, comprising the steps of:

a) providing a selected length of a compressible, resilient material having an axis parallel to a length dimension thereof;

b) compressing the length of compressible, resilient material in a direction substantially parallel to the axis;

c) holding the compressed length of compressible, resilient material so that the axis is substantially horizontal;

d) inserting the compressed length of compressible, resilient material into a vertically oriented container having a plurality of pills therewithin so that the axis of the compressible, resilient material is substantially perpendicular to the orientation of the container; and e) releasing the compressed length of compressible, resilient material within the container to allow the material to expand horizontally within the container along the axis of the compressible, resilient material to occupy a significant portion of a space above the pills.

2. The method of claim 1 wherein the compressible, resilient material is tubular.

3. The method of claim 2, wherein the compressible, resilient tubular material is supplied in flattened condition and the method further comprises causing the tubular material to assume a substantially round configuration in a plane substantially perpendicular to the axis.

4. The method of claim 1 further comprising the step of cutting the selected length of compressible, resilient material from an elongate supply of such compressible, resilient material.

5. The method of claim 1, wherein the compressible, resilient material is hydrophobic.

6. A method for protecting a plurality of pharmaceutical products formed as pills and packaged in a container, comprising the steps of:

a) providing a filler of a selected length and having an axis;

b) cutting the selected length of filler from an elongate supply of such filler material;

c) compressing the filler along the axis;

d) holding the compressed filler so that the axis is substantially horizontal;

e) inserting the compressed filler into a container having a plurality of pills th r within, the container having an axis that is substantially vertical;

releasing the compressed filler within the container to allow the filler to expand with the axis of the filler substantially perpendicular to the axis of the container so as to occupy a significant portion of a space above the pills; and g) wherein the elongate supply of filler is in flattened condition.

7. The method of claim 6, wherein the filler is tubular.

8. The method of claim 6, wherein the filler is hydrophobic.

* * * * *